US005097508A

United States Patent [19]

Valenzuela Steude et al.

[11] Patent Number: 5,097,508

[45] Date of Patent: Mar. 17, 1992

[54] DIGITAL SPEECH CODER HAVING IMPROVED LONG TERM LAG PARAMETER DETERMINATION

[75] Inventors: Reinaldo A. Valenzuela Steude, Wellesley; Ronald G. Danisewicz, Methuen, both of Mass.

[73] Assignee: Codex Corporation, Canton, Mass.

[21] Appl. No.: 402,958

[22] Filed: Aug. 31, 1989

[51] Int. Cl.[5] ..... G10L 3/02

[52] U.S. Cl. ..... 381/36

[58] Field of Search ..... 381/29-40; 364/513.5

[56] References Cited

U.S. PATENT DOCUMENTS

| | | | |
|---|---|---|---|
| 4,797,925 | 1/1989 | Lin | 381/34 |
| 4,811,396 | 3/1989 | Yatsuzuka | 381/30 |
| 4,817,157 | 3/1989 | Gerson | 381/40 |
| 4,868,867 | 9/1989 | Davidson et al. | 381/36 |
| 4,924,508 | 5/1990 | Crepy et al. | 381/38 |
| 4,933,957 | 6/1990 | Bottau et al. | 381/29 |
| 4,965,789 | 10/1990 | Bottau et al. | 381/31 |

OTHER PUBLICATIONS

Article entitled "Real-Time Vector APC Speech Coding at 4800 BPS with Adaptive Postfiltering" by Jui-n-Hwey Chen and Allen Gersho—1987 IEEE, pp. 51.3.1-51.3.4.

*Primary Examiner*—Dale M. Shaw
*Assistant Examiner*—Michelle Doerrler
*Attorney, Agent, or Firm*—Darleen J. Stockley; Charles L. Warren

[57] ABSTRACT

A method and apparatus is provided for determining the lag of a long term filter in a code excited linear prediction speech coder. An open loop lag is first determined using an autocorrelation function. The open loop lag is then utilized to generate a limited range over which a closed loop search is performed. The range for appropriate values includes lags that are harmonically related to the open loop lag as well as adjacent lags.

16 Claims, 6 Drawing Sheets

500
B
ORDER THE Np LARGEST P(N) FROM SMALLEST TO LARGEST LAG WHERE THE LAGS ARE I(1)<I(2)...<I(Np)
501
LET d1 = 4I(1)
d2 = 4I(2)
dNp = 4I(Np)
502
i = 1
503
K = di-2
504
MAXi = 0 d'i = k
505
f(k)= Σ n=0 NF-1 (X(n)X(n-k))2 / Σ n=0 NF-1 X(n-k)x(n-k)
506
IS f(k) > MAXi ?
507
NO
YES
MAXi = f(k), d'i = k
508
k = k+1
509
IS F(k) > MAXi ?
510
NO
YES
k = k+1
511
IS i > 5 ?
512
YES
NO
C

600

$k = L_{OPEN}$

| k<=30 |
|---|
| $L_1 = 3k-1$ |
| $L_2 = 3k$ |
| $L_3 = 3k+1$ |
| $L_4 = 4k-1$ |
| $L_5 = 4k$ |
| $L_6 = 4k+1$ |
| $L_7 = k$ |
| $L_8 = 2k$ |

| 30<k<=48 |
|---|
| $L_1 = 2k-1$ |
| $L_2 = 2k$ |
| $L_3 = 2k+1$ |
| $L_4 = 3k-2$ |
| $L_5 = 3k-1$ |
| $L_6 = 3k$ |
| $L_7 = 3k+1$ |
| $L_8 = k$ |

| k=49 |
|---|
| $L_1 = 2k-1$ |
| $L_2 = 2k$ |
| $L_3 = 2k+1$ |
| $L_4 = 3k-2$ |
| $L_5 = 3k-1$ |
| $L_6 = 3k$ |
| $L_7 = k-1$ |
| $L_8 = k$ |

| 49<k<=72 |
|---|
| $L_1 = k-1$ |
| $L_2 = k$ |
| $L_3 = k+1$ |
| $L_4 = 2k-2$ |
| $L_5 = 2k-1$ |
| $L_6 = 2k$ |
| $L_7 = 2k+1$ |
| $L_8 = 2k+2$ |

| k=73 |
|---|
| $L_1 = 1-1$ |
| $L_2 = k$ |
| $L_3 = k+1$ |
| $L_4 = 2k-2$ |
| $L_5 = 2k-1$ |
| $L_6 = 2k$ |
| $L_7 = 2k+1$ |
| $L_8 = k+2$ |

| 73<k<=143 |
|---|
| $L_1 = k-3$ |
| $L_2 = k-2$ |
| $L_3 = k-1$ |
| $L_4 = k$ |
| $L_5 = k+1$ |
| $L_6 = k+2$ |
| $L_7 = k+3$ |
| $L_8 = k+4$ |

| k=144 |
|---|
| $L_1 = k-4$ |
| $L_2 = k-3$ |
| $L_3 = k-2$ |
| $L_4 = k-1$ |
| $L_5 = k$ |
| $L_6 = k+1$ |
| $L_7 = k+2$ |
| $L_8 = k+3$ |

| k=145 |
|---|
| $L_1 = k-5$ |
| $L_2 = k-4$ |
| $L_3 = k-3$ |
| $L_4 = k-2$ |
| $L_5 = k-1$ |
| $L_6 = k$ |
| $L_7 = k+1$ |
| $L_8 = k+2$ |

| k=146 |
|---|
| $L_1 = k-6$ |
| $L_2 = k-5$ |
| $L_3 = k-4$ |
| $L_4 = k-3$ |
| $L_5 = k-2$ |
| $L_6 = k-1$ |
| $L_7 = k$ |
| $L_8 = k+1$ |

| k=147 |
|---|
| $L_1 = k-7$ |
| $L_2 = k-6$ |
| $L_3 = k-5$ |
| $L_4 = k-4$ |
| $L_5 = k-3$ |
| $L_6 = k-2$ |
| $L_7 = k-1$ |
| $L_8 = k$ |

*FIG. 7*

DIGITAL SPEECH CODER HAVING IMPROVED LONG TERM LAG PARAMETER DETERMINATION

BACKGROUND OF THE INVENTION

The present invention generally relates to a digital speech encoder having a long term filter in which delay (lag) is a parameter. This invention is particularly, but not exclusively, suited for use in a code-excited linear prediction (CELP) speech encoder.

In a CELP encoder, long term and short term filters are excited by an excitation vector selected from a table of such vectors. The speech is represented in a CELP encoder by an excitation vector, lag and gain parameters associated with the long term filter, and a set of parameters associated with the short term filter. These parameters are transmitted to the receiver which produces a representation of the original speech based upon these parameters.

The long term filter lag L can be determined from either an open loop or closed loop method. In the open loop method, the lag is determined directly from the input signal in the transmitter. The lag can be determined to be the delay that achieves the greatest value of a normalized autocorrelation function. The autocorrelation function must be calculated for each lag that is tested.

A variation of the open loop method which requires less computational loading comprises finding the maximum normalized autocorrelation of a decimated speech signal. Since fewer samples are tested, less computations are required. The delay of the decimated signal is multiplied by the decimation factor to obtain a delay value that corresponds to the undecimated signal. The lag found by this method has less resolution since it is based on a decimated signal. Greater resolution can be obtained by testing lags adjacent the computed undecimated lag. See Juin-Hwey Chen and Allen Gersho, "Real-Time Vector APC Speech Coding at 4800 BPS with Adaptive Postfiltering", *Proceedings of the IEEE International Conference on Acoustics, Speech and Signal Processing*, Vol. 4, pp 2185–2188, April 1987.

In a closed loop method of determining the lag, trial lags and gains of the long term filter are tested to minimize the mean square of the weighted error between the speech signal and the output of the cascaded long term and short term filters. This approach attempts to find a match between the coded data in the delay line of the long term filter and the input signal. The long term lag and gain determination is based on the actual long term filter state that will exist at the receiver where speech is synthesized. Hence, the closed loop method achieves better resolution than the open loop method but at the cost of significantly more computations.

SUMMARY OF THE INVENTION

It is an object of the present invention to provide an improved method and apparatus for determining the lag of a long term filter in a speech encoder which has high resolution but with reduced bit rate and computational loading requirements.

One aspect of the invention is directed to the use of an open loop lag search. A set of delays having autocorrelation peaks (maximum values) is found. In one embodiment, the search is performed upon an input signal decimated by a factor of 4. Using the decimated signal a normalized autocorrelation function is calculated and the lags having peaks are found. The delays of a few of the largest peaks are translated into the undecimated original signal domain by multiplying by 4. Normalized autocorrelations are then computed over a small range in the vicinity of the translated (undecimated) lags using the undecimated signal. A delay $D_p$ associated with the maximum autocorrelation value is stored. A predetermined number, such as 5, of the delays which achieve an autocorrelation value of a predetermined percentage of $D_p$, such as 75%, are retained and the corresponding lags are organized into a group of lags by ascending lag value. Beginning with the lag having the lowest delay, each is tested to determine if it is harmonically related to $D_p$. The first lag found to have a harmonic relationship is selected to be used as the open loop lag. Thus this method favors the selection of the trial lag from the group of lags which has the lowest value. If none of the trial lags are harmonically related to $D_p$, then $D_p$ is selected as the open loop lag.

Another aspect of the present invention relates to the use of an open loop lag to define a predetermined range for a closed loop long term predictor search. The closed loop search range includes lags adjacent the open loop lag and integer multiples (harmonics) of the open loop lag and lags adjacent such harmonics. The lag having the smallest closed loop search error is selected as the lag for the long term filter. The use of such an open loop lag in combination with a limited closed loop lag search results in improved resolution with minimized computational loading as contrasted with a conventional open loop method.

BRIEF DESCRIPTION OF THE DRAWINGS

FIG. 7 is a table illustrating the mapping in accordance with block 307 in FIG. 3.

DETAILED DESCRIPTION OF THE PREFERRED EMBODIMENT

An important aspect of the present invention resides in the recognition that a relationship often exists between the long term lag parameter determined by an open loop method and the same parameter determined by a closed loop technique. The closed loop lag often occurs around a multiple or harmonic of the open loop lag. Thus, selecting the smallest open loop lag having a substantial normalized autocorrelation value which is harmonically related to $D_p$ may give improved results especially where a subsequent closed loop lag is based upon it.

Figure 1:
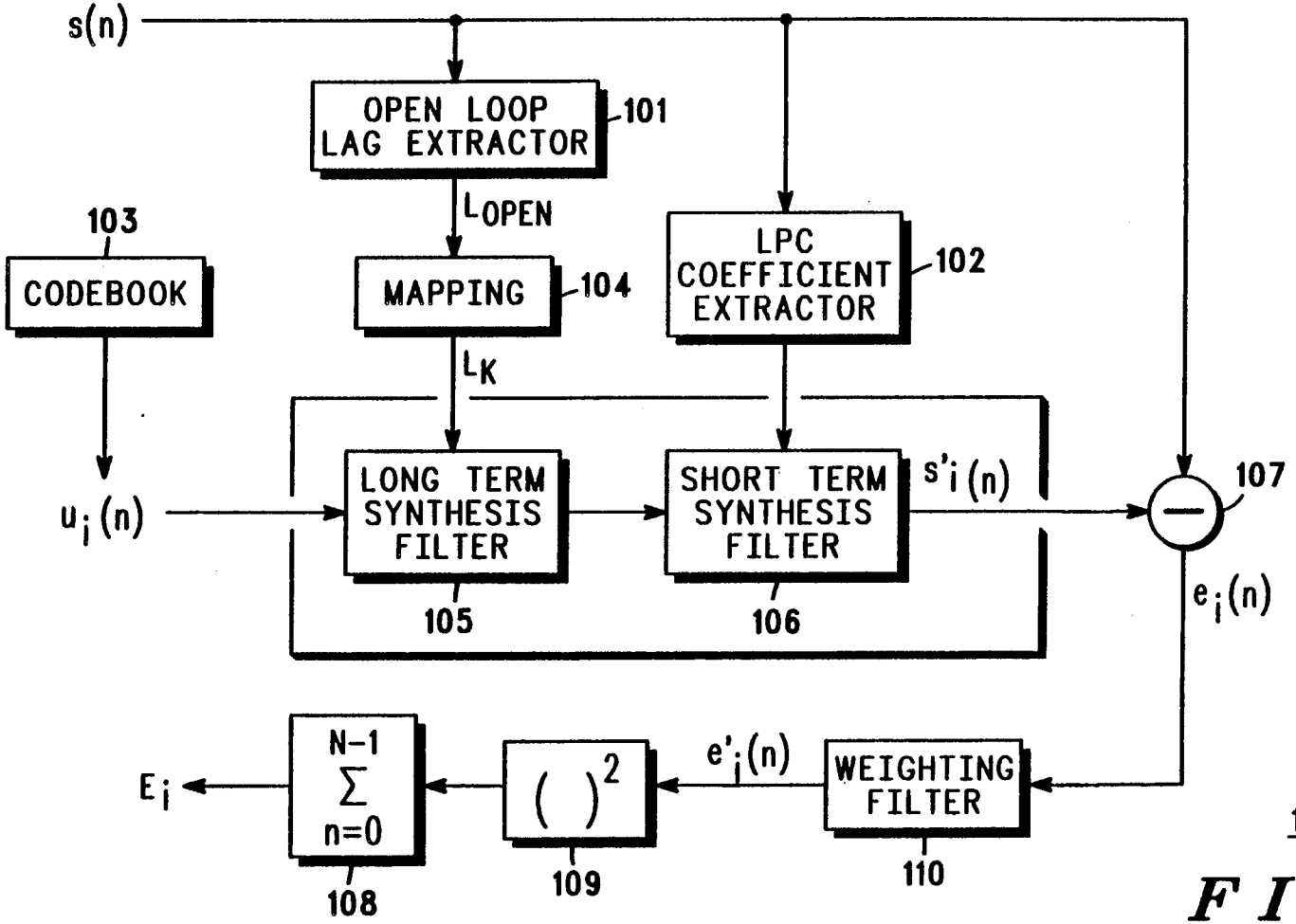
FIG. 1 is a block diagram of a CELP encoder which includes an embodiment of a long term lag predictor according to the present invention.

FIG. 1 illustrates an embodiment of a CELP speech encoder 100 which incorporates improvements according the present invention. A digitized signal s(n) which will typically consist of speech is applied to the input of the encoder. The object of the encoder is to determine the parameters and excitation which minimize the mean square value $E_i$. These parameters are sent to a corresponding receiver.

At the receiver, speech is synthesized by applying an excitation vector contained within codebook 103 in accordance with a codeword parameter received from the transmitter to the cascade of long term filter 105 and short term filter 106. The transmitter provides the receiver with the parameters associated with these filters and an identification of the excitation vector to be selected.

After the filter parameters have been selected, the transmitter can determine the excitation vector by searching codebook 103. Each excitation vector $u_i(n)$ is passed through the filters and the error $E_i$ represented by the mean square value of the output $E'_i(n)$ of weighting filter 110 computed by squaring block 109 and summation block 108. The vector that achieves the lowest error is selected. An index or codeword associated with the excitation vector is sent to the receiver.

The short term filter parameters $a_k$ are determined by LPC coefficient extractor 102. These parameters model the short time correlations in the input waveform.

The lag parameter for long term filter 105 is determined by open loop lag extractor 101 and mapping block 104 which are described in detail hereinafter. The open loop lag extractor 101 extracts an open loop lag $L_{open}$ once each frame. Mapping block 104 maps the open loop lag into a range of lags which forms the basis of a closed loop lag search from which a final lag is selected.

Subtracter 107 generates an error signal $e_i(n)$ based on the difference between the input signal s(n) and the synthesized input signal $s'_i(n)$. The error signal is then filtered by weighting filter 110 and its output squared by block 109 and summed by block 108 to produce a resulting average mean squared error $E_i$. The synthesized signal which produces the smallest error $E_i$ represents the optimal choice of parameters for the input signal samples being considered.

Figure 2A:
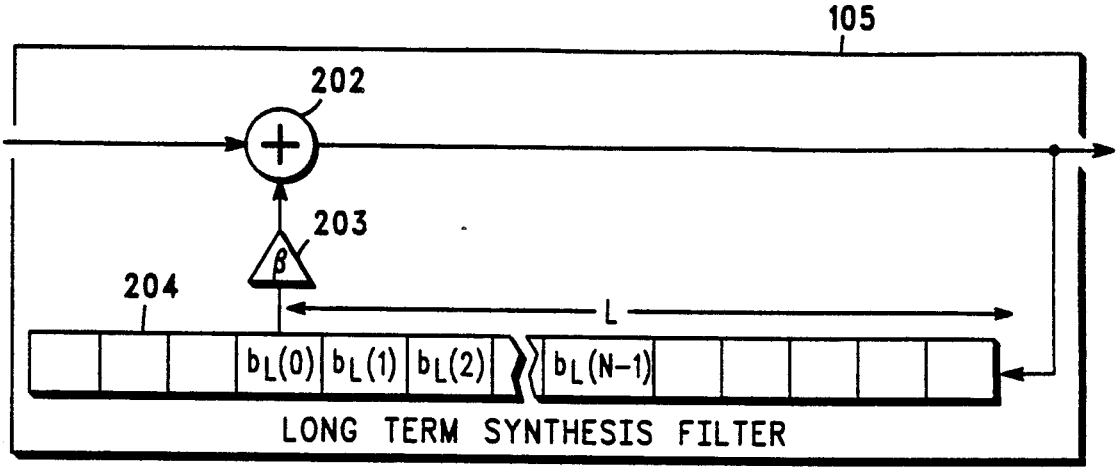
FIG. 2A is a simplified block diagram of a long term filter.

FIG. 2A shows a simplified block diagram of long term filter 105. It consists of a summer 202 which sums the input $u_i(n)$ with the output of the summer which is delayed for L samples by delay line 204 and multiplied by a gain of $\beta$ by amplifier 203. The variable delay L of delay line 204 represents the lag parameter of long term filter 105 and the value of gain represented by $\beta$ represents the other parameter of the filter.

Figure 2B:
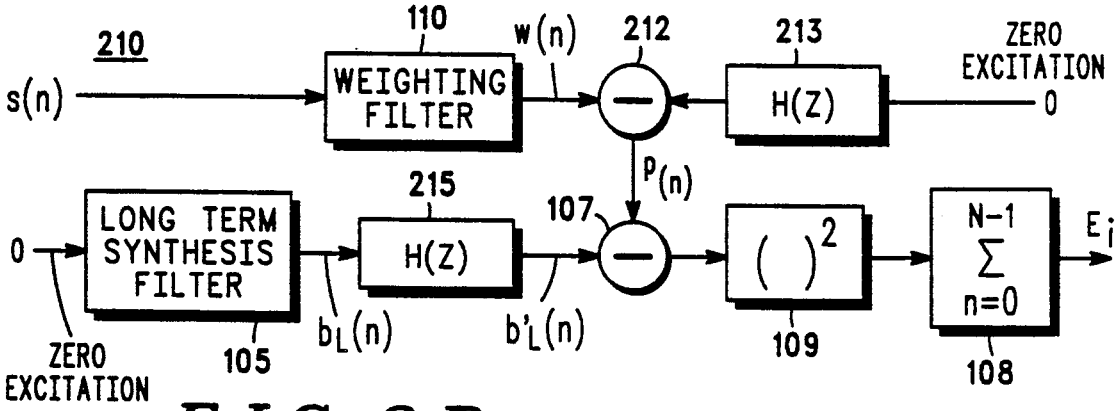
FIG. 2B is a block diagram of an implementation of a CELP encoder that illustrates a closed loop search method for the lag parameter of the long term filter.

FIG. 2B is an equivalent embodiment representing the encoder as shown in FIG. 1. This embodiment 210 is utilized to explain the closed loop search for the lag parameter of long term filter 105. The weighting filter 110 of FIG. 1 has been shifted from the output from subtracter 107 and placed in series with both the input signal and the synthesized input signal. Blocks 213 and 215 represent the transfer function H(z) of the short term filter 106 in series with weighting filter 110. Each closed loop lag candidate as determined by mapping block 104 is tested once per a subframe of the frame by extracting the subframe samples $b_L(n)$ that correspond to the lag of filter 105 from the state of delay element 204 and gain $\beta$. These samples are then passed through block 215 to yield $b'_L(n)$. The state of block 215 is initialized to zero for each lag tested. The zero-input response of function H(z), which is the output of H(z) in the absence of any excitation, is subtracted from the weighted input sequence w(n) by block 213 to yield p(n). The difference of p(n) and $b'_L(n)$ is squared by block 109 and summed by block 108 to produce error $E_i$. The lag parameter which yields the lowest error $E_i$ represents the optimal lag choice.

Figure 3:
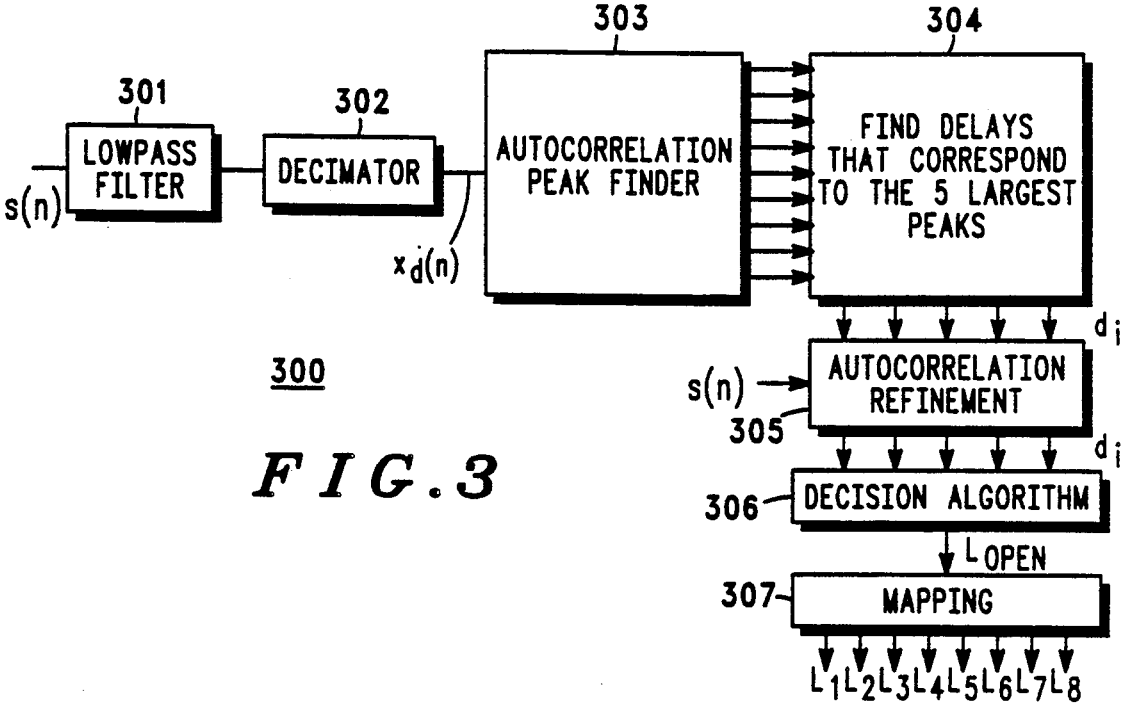
FIG. 3 is a block diagram illustrating functions performed by an embodiment of the present invention.

FIG. 3 illustrates the basic steps for the open loop lag parameter selection and its use in a closed loop parameter search. Although FIG. 3 illustrates the procedure in block diagram form, the long term lag parameter search is accomplished in software and is described more particularly in FIGS. 4–6.

The input signal s(n) is filtered by low pass filter 301 and decimated by decimator 302 to yield a decimated input signal of $x_D(n)$. In the exemplary embodiment, decimation is by a factor of 4. Autocorrelation peak finder 303 locates correlation peaks or values for various trial lags associated with the decimated input signal. The peaks P(n) and the corresponding lags I(n) are inputs to block 304 which identifies the lags that correspond to a predetermined set (5 in the illustrative embodiment) of the largest correlation peaks. These lags $d_i$ and the corresponding peak values are input to autocorrelation refinement block 305 which converts the delays based upon the decimated signal to delays $d'_i$ based upon the undecimated input signal s(n).

The refined lags $d'_i$ provide inputs to decision algorithm block 306 which selects one of the five lags as the open loop lag parameter $L_{open}$ based upon an algorithm which favors selection of the lag having the least delay which is a harmonic of the lag $D_p$ having the maximum correlation value. This algorithm will be further described in FIG. 6. The open loop lag $L_{open}$ is provided as an input to mapping block 307 which is mapped into a sequence of N (8 in the illustrative embodiment) possible lags to be tested in a closed loop search described in FIG. 7. The lag of trial lags $L_1L_8$ having the smallest average mean square error is selected as the final lag parameter to be utilized for the long term filter.

Figure 4:
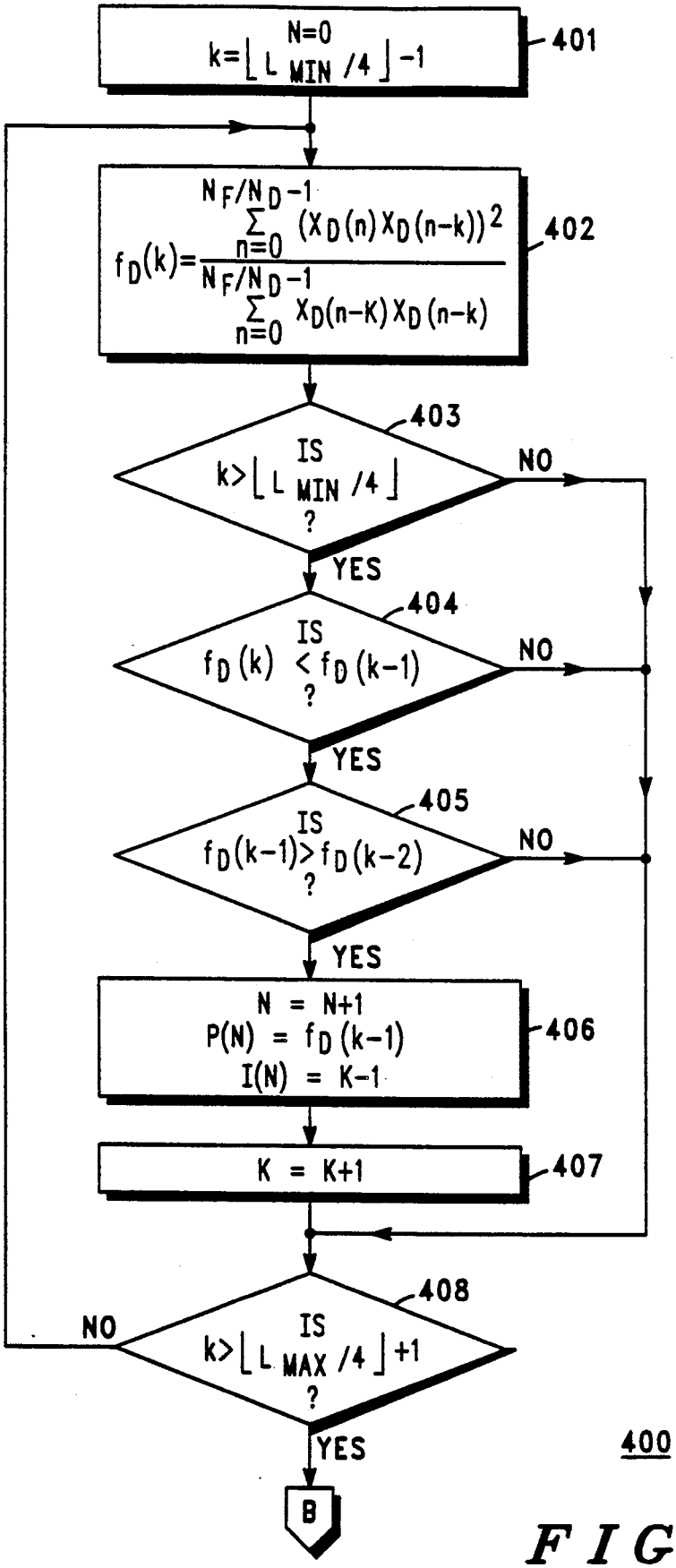
FIG. 4 is a flow chart illustrating a method for accomplishing the function of block 303 in FIG. 3.

FIG. 4 shows a flow diagram 400 illustrating an autocorrelation determination method used by block 303 in FIG. 3. The parameters are defined as follows: N identifies the number of peaks found, k represents lag values, $L_{min}$ and $L_{max}$ are minimum and maximum lag values to be considered, $f_D(k)$ represents the value of the normalized autocorrelation function for lag k, P(N) stores the Nth autocorrelation peak for lag $k-1$ and I(N) stores the corresponding $k-1$ lag. The bold lower half bracket and the bold upper half bracket represent operators which denote the greatest integer less than its argument and the smallest integer greater than its argument, respectively.

Block 401 shows initialization of the subframe count N to zero and k to the lowest lag to be considered. The lags being considered are for an input signal decimated by 4 and thus require scaling of k by a factor of 4. Block 402 illustrates the normalized autocorrelation formula which determines the degree of correlation between decimated samples $x_D(n)$ and $x_D(n-k)$. This function is generally known in the art.

Blocks 403, 404, and 405 show a series of decisions which must all be true for the lag $k-1$ under consideration to be identified as having a normalized autocorrelation peak. If these decisions are all true, block 406 stores the peak value P(N) and the lag I(N) associated with lag $k-1$, and increments N.

Block 407 increments k to the next trial lag. Decision block 408 tests the new lag value to determine if it is less than the maximum lag to be considered. If the lag k is less than the maximum, the next value of lag is tested in accordance with the preceding description. If the new lag k exceeds the maximum value, further processing of flow chart 400 ceases and the program passes to entry point "B" of FIG. 5. Thus, this procedure has recognized and stored the autocorrelation peaks and lags associated with the peaks.

Figure 5:
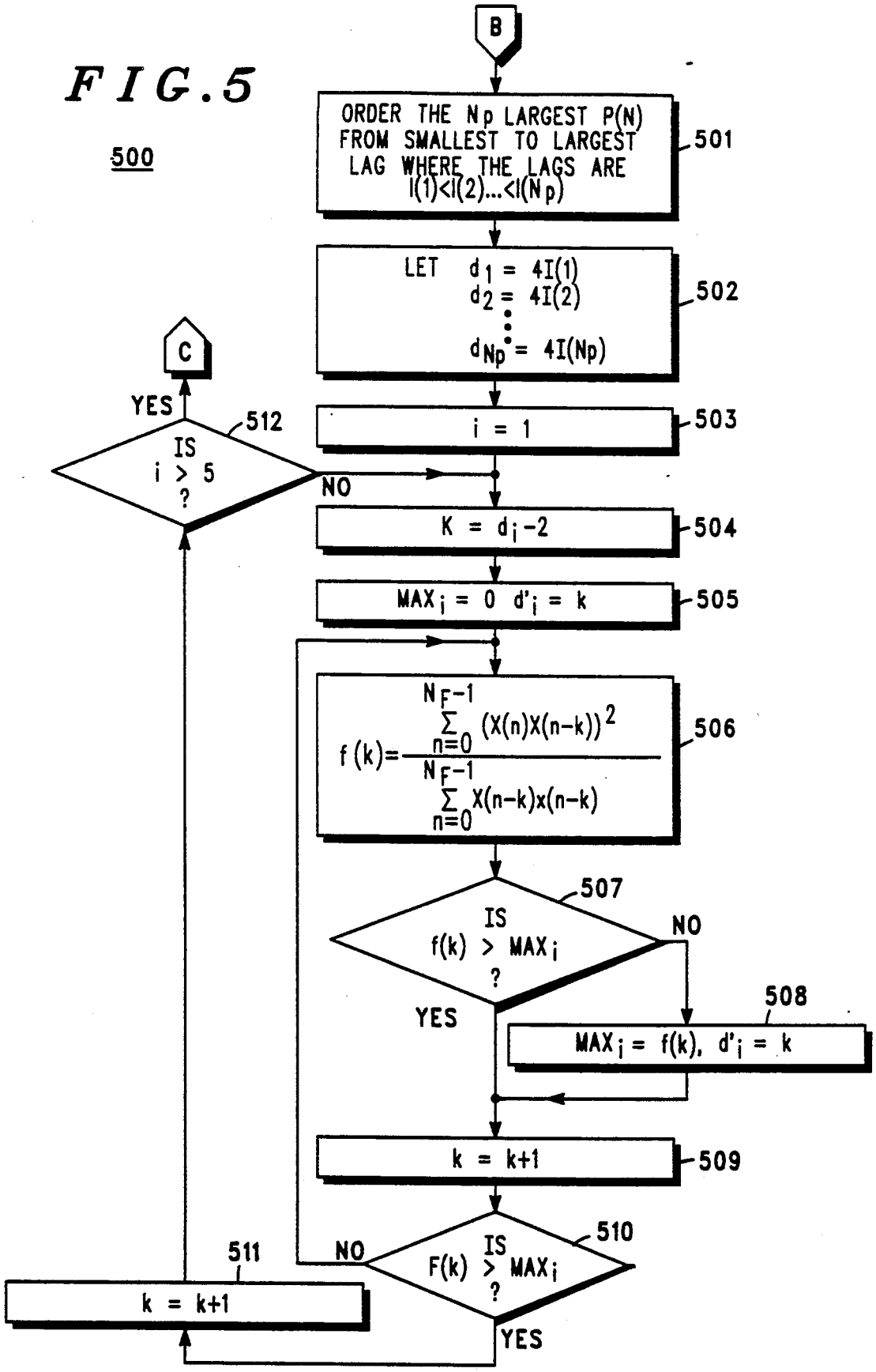
FIG. 5 is a flow chart illustrating a method for accomplishing the functions of blocks 304 and 305 in FIG. 3.

FIG. 5 shows flow diagram 500 which carries out the functions of blocks 304 and 305 of FIG. 3. Block 501 identifies the $N_o$ largest peaks ($N_p=5$ in the illustrative embodiment) and orders the corresponding lags I(N) from the smallest to largest delay, not according to the peak magnitude. In block 502 parameter $d_N$ corresponds to the lags identified in block 501 which are converted to the undecimated delay magnitude by multiplying each by 4. In this diagram, parameters i and k represent integer variables where i identifies the number of the lag being refined and k represents the lag value. The parameter $max_i$ stores the maximum autocorrelation value for each refined lag as determined in the autocorrelation refinement step.

For each lag to be refined and for a range of lags from $d_n-2$ to $d_n+2$ (see 504, 510) the normalized autocorrelation function in block 506 is computed. The largest peak is stored as $max_i$ and the corresponding lag stored as $d'_i$ (see 507, 508). After the range of lags around trial lag $d_1$ have been calculated as determined by decision 510, the autocorrelation refinement continues for each of the 4 remaining stored lags. Blocks 503 and 504 initialize the i and k parameters; blocks 509 and 511 increment parameters k and i. Decision block 512 senses when the last trial lag calculations have been completed. The program transfers control to "C" as continued in FIG. 6.

The general purpose of FIG. 5 is to identify the delays that correspond to the 5 largest peaks, order the delays in ascending order by delay magnitude, and perform a further refined autocorrelation determination based on the undecimated lags. In the illustrative example each undecimated lag is searched over a range of ±2. This range takes the possible error that may have occurred due to decimation into account. At the completion of the operation of flow diagram 500, a maximum autocorrelation peak is stored for each of 5 lags.

Figure 6:
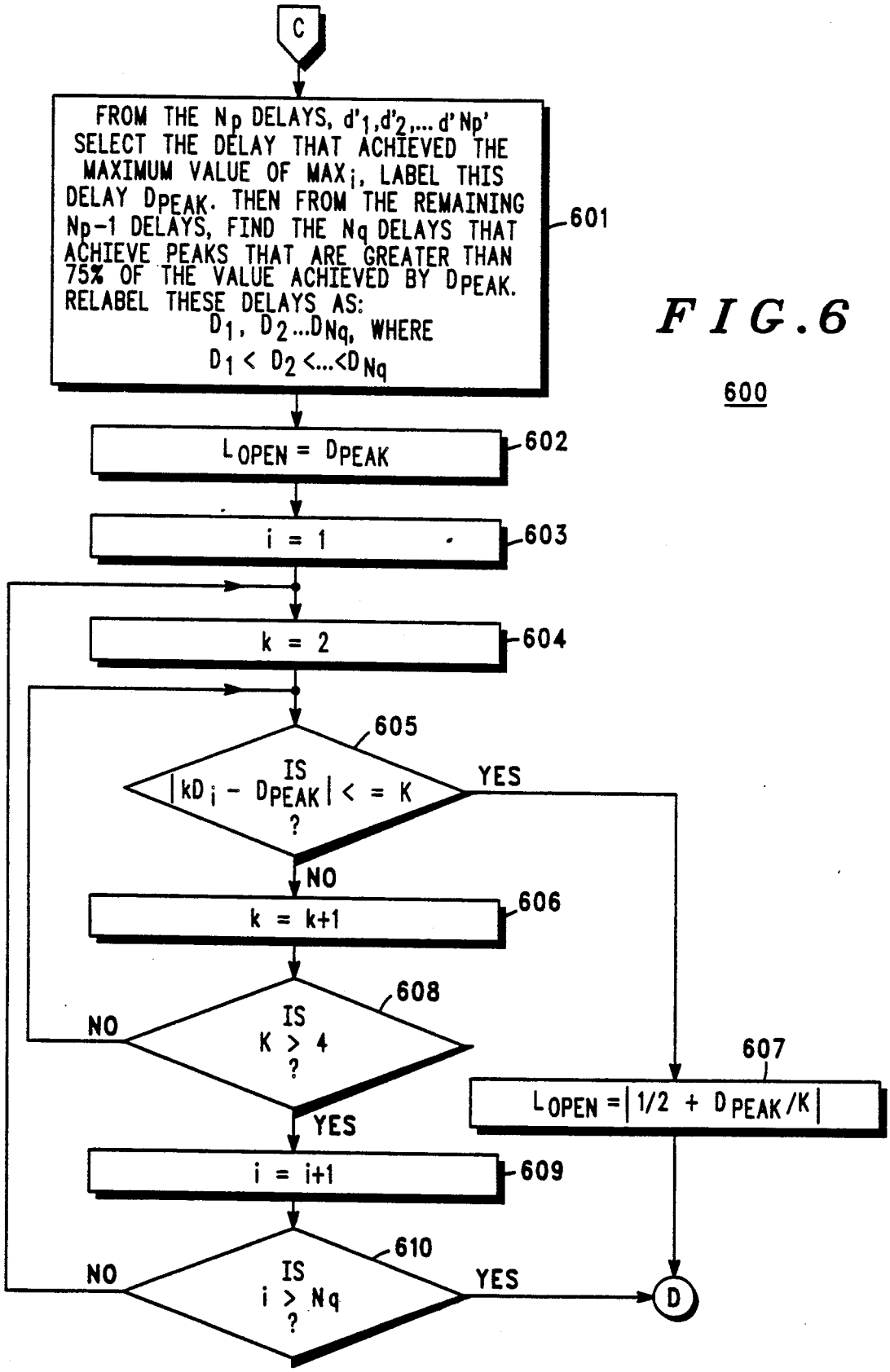
FIG. 6 is a flow chart illustrating a method for accomplishing the function of block 306 in FIG. 3.

FIG. 6 illustrates flow chart 600 which carries out the decision algorithm referenced by block 306 in FIG. 3. In block 601, the lag having the largest autocorrelation peak $max_i$ is identified as $D_{peak}$. The remaining lags are then considered to find those having at least a predetermined percentage of $D_{peak}$ (in this embodiment—75%). The lags having peaks of at least 75% are relabeled as $D_1 \ldots D_{Nq}$ in ascending numerical order, i.e., where $D_1$ has the smallest lag of this group. Block 602 defines $L_{open}$ as equal to $D_{peak}$. The parameter i represents a counter which indexes the $N_q$ series. The parameter k in this diagram represents integer values for harmonic relationships and is allowed to range from 2–4. Decision block 605 determines if the lag $D_i$ is harmonically related to lag $D_{peak}$. Upon block 605 finding the first harmonic relationship (yes), block 607 redefines $L_{open}$ as that subharmonically related lag and the program exits at "D". Thus, it will be seen that the lag selection decision is biased in favor of selecting the smallest lag which has the closest harmonic relationship to $D_{peak}$. As will be understood from flow diagram 600, if none of the $N_q$ lags are harmonically related to $D_{peak}$ then the program will exit by a "yes" decision by 610 in which $L_{open}$ will remain defined as $D_{peak}$. Blocks 603 and 604 initialize parameters i and k; blocks 606 and 609 increment these parameters.

FIG. 7 shows a series of tables which illustrate the mapping according to block 307 of FIG. 3. The lag value $L_{open}$ is referred to as k in FIG. 7. The 10 tables map values of k into 8 trial lags $L_1$–$L_8$ which are each tested by a closed loop lag search. The trial lag having the smallest closed loop error is selected as the lag to be utilized by long term filter 105.

It will be seen from FIG. 7 that for the lower values of k, trial values harmonically related to k are searched as well as ranges about the harmonics. At the higher values of k, it will be seen that only search ranges adjacent k are considered since harmonics higher than these values of k are known to exceed the range in which lag values corresponding to normal speech exist.

The method of the present invention for determining the lag parameter to be utilized by a long term filter in a digital speech encoder is only slightly more computationally intensive than an open loop lag search but yields resolution comparable to the closed loop lag search.

Although an embodiment of the present invention has been described above and illustrated in the drawings, the scope of the invention is defined by the claims which follow.

What is claimed is:

1. A digital speech encoding method that produces parameters representative of samples of digitized speech comprising the steps of:

storing a plurality of excitation signals;

filtering said excitation signals using a long term filter to produce corresponding filtered signals, said long term filter having a time lag filter characteristic controlled by a time lag parameter;

generating error signals based upon the difference between said filtered signals and a sample of digitized speech;

selecting the excitation signal corresponding to the smallest error signal for use with said sample of digitized speech;

generating said time lag parameter by:

calculating correlation values based on trial time lags of different lengths;

evaluating said correlation values and selecting a predetermined number of the trial time lags having the larger of said correlation values, the maximum value of said number having a corresponding lag $D_p$;

determining if at least one of said number of trial time lags is harmonically related to lag $D_p$, if at least one of said predetermined number of lags is harmonically related to lag $D_p$ selecting the smallest to said harmonically related lags for use as said lag parameter, if none of said number of trial time lags are harmonically related to lag $D_p$ selecting $D_p$ as said lag parameter;

filtering a sample of digitized speech using the long term filter with the time lag filter characteristic controlled by said selected lag parameter.

2. The method according to claim 1 wherein said determining step further comprises the steps of defining a range of lags consisting of continuous lags and including lag $D_p$ and said calculating step includes calculating correlation values based on said continuous lags, and making said harmonically related determination based on an integer multiple of said number of lags being within said range.

3. A digital speech encoder that produces parameters representative of samples of digitized speech comprising:

codebook means for storing a plurality of excitation signals;

long term filter which filters said excitation signals to produce corresponding filtered signals, said long term filter having a time lag filter characteristic controlled by a time lag parameter;

means for generating error signals based upon the difference between said filtered signals and a sample of digitized speech;

means for selecting the excitation signal corresponding to the smallest error signal for use with said sample of digitized speech;

means for generating said time lag parameter comprising:

means for calculating correlation values based on trial time lags of different lengths;

means for evaluating said correlation values and means for selecting a predetermined number of the trial time lags having the larger of said correlation values, the maximum value of said number having a corresponding lag $D_p$;

means for determining if at least one of said predetermined number of trial time lags is harmonically related to lag $D_p$;

means for selecting the smallest of said harmonically related lags as said lag parameter if a harmonically related lag exists, if none of said number of trial time lags are harmonically related to lag $D_p$ selecting $D_p$ as said lag parameter;

said long term filter filtering samples of digitized speech using the time lag filter characteristic controlled by said selected lag parameter.

4. The encoder according to claim 3 further comprising means for defining a range of lags consisting of continuous lags and including lag $D_p$, said calculating means calculating correlation values based on said continuous lags, and said means for determining making said determination dependent on whether an integer multiple of one of said number of lags is within said range.

5. A digital speech encoding method that produces parameters representative of samples of digitized speech comprising the steps of:

storing a plurality of excitation signals;

filtering said excitation signals using a long term filter to produce corresponding filtered signals, said long term filter having a time lag filter characteristic controlled by a time lag parameter;

generating error signals based upon the difference between said filtered signals and a sample of digitized speech;

selecting the excitation signal corresponding to the smallest error signal for use with said sample of digitized speech;

generating said time lag parameter by:

calculating an open loop lag parameter $L_{open}$;

conducting a predetermined series of tests of closed loop lag parameters dependent on the value of open loop lag parameter $L_{open}$ to determine the error associated with each closed loop lag parameter tested;

selecting the closed loop lag parameter with the smallest error as said time lag parameter;

filtering samples of digitized speech using the long term filter with the time lag filter characteristic controlled by lag parameter L.

6. The method according to claim 5 wherein said step of conducting tests comprises the steps of testing closed loop lag parameters harmonically related to open loop lag parameter $L_{open}$.

7. The method according to claim 6 wherein the number of harmonics of $L_{open}$ tested depends on the value of parameter $L_{open}$ relative to a predetermined maximum value.

8. The method according to claim 6 wherein said conducting step conducts said predetermined series of closed loop lag parameter tests using undecimated samples of digitized speech.

9. The method according to claim 5 wherein said conducting step conducts said predetermined series of closed loop lag parameter tests using undecimated samples of digitized speech.

10. The method according to claim 9 wherein said calculating of the open loop lag parameter $L_{open}$ is based on a decimated sample of the digitized speech.

11. A digital speech encoder that produces parameters representative of samples of digitized speech comprising:

codebook means for storing a plurality of excitation signals;

long term filter which filters said excitation signals to produce corresponding filtered signals, said long term filter having a time lag filter characteristic controlled by a time lag parameter;

means for generating error signals based upon the difference between said filtered signals and a sample of digitized speech;

means for selecting the excitation signal corresponding to the smallest error signal for use with said sample of digitized speech;

means for generating said time lag parameter comprising:

means for calculating an open loop lag parameter $L_{open}$;

means for conducting a predetermined series of tests of closed loop lag parameters dependent on the value of open loop lag parameter $L_{open}$ to determine the error associated with each test;

means for selecting said closed loop lag parameter with the smallest error as said time lag parameter;

said filter filtering samples of digitized speech with the time lag filter characteristic controlled by said time lag parameter.

12. The encoder according to claim 11 wherein said means of conducting tests comprises means for testing closed loop lag parameters harmonically related to open loop lag parameter $L_{open}$.

13. The encoder according to claim 12 wherein the number of harmonics of $L_{open}$ tested depends on the value of parameter $L_{open}$ relative to a predetermined maximum value.

14. The encoder according to claim 12 wherein said conducting means conducts said predetermined series of closed loop lag parameter tests using undecimated samples of digitized speech.

15. The encoder according to claim 11 wherein said conducting means conducts said predetermined series of closed loop lag parameter tests using undecimated samples of digitized speech.

16. The encoder according to claim 15 wherein said means for calculating calculates the open loop lag parameter $L_{open}$ based on a decimated sample of the digitized speech.

* * * * *